US008910567B2

(12) United States Patent
Moch et al.

(10) Patent No.: US 8,910,567 B2
(45) Date of Patent: Dec. 16, 2014

(54) COMPACTING DEVICE

(75) Inventors: Anton Moch, Ibbenbüren (DE); Maik Schulenberg, Bramsche (DE)

(73) Assignee: Envipco Holding N.V., Amersfoort (NL)

( * ) Notice: Subject to any disclaimer, the term of this patent is extended or adjusted under 35 U.S.C. 154(b) by 639 days.

(21) Appl. No.: 13/128,807

(22) PCT Filed: Oct. 22, 2009

(86) PCT No.: PCT/DE2009/001480

§ 371 (c)(1),
(2), (4) Date: Aug. 3, 2011

(87) PCT Pub. No.: WO2010/054615

PCT Pub. Date: May 20, 2010

(65) Prior Publication Data

US 2012/0017782 A1 Jan. 26, 2012

(30) Foreign Application Priority Data

Nov. 13, 2008 (DE) ..... 10 2008 057 137

(51) Int. Cl.
*B30B 3/04* (2006.01)
*B30B 9/32* (2006.01)
*B26F 1/24* (2006.01)

(52) U.S. Cl.
CPC . *B30B 9/325* (2013.01); *B26F 1/24* (2013.01); *B26F 2210/11* (2013.01); *Y10S 100/902* (2013.01)
USPC ..... 100/176; 100/98 R; 100/902

(58) Field of Classification Search
USPC ..... 100/94, 96, 97, 98 R, 98 A, 155 R, 161, 100/172, 176, 902; 241/230, 235, 236, 280
See application file for complete search history.

(56) References Cited

U.S. PATENT DOCUMENTS

| | | | | |
|---|---|---|---|---|
| 1,598,364 | A * | 8/1926 | Cassell et al. | 225/100 |
| 4,009,838 | A * | 3/1977 | Tashman | 241/99 |
| 4,669,673 | A * | 6/1987 | Lodovico et al. | 241/99 |
| 4,723,870 | A * | 2/1988 | Martinez | 404/121 |
| 5,556,039 | A * | 9/1996 | Minamimura et al. | 241/18 |

(Continued)

FOREIGN PATENT DOCUMENTS

| | | | |
|---|---|---|---|
| DE | 20316366 | U1 | 3/2005 |
| DE | 10353188 | A1 | 6/2005 |
| JP | 2003 285296 | A | 10/2003 |

OTHER PUBLICATIONS

International Search Report dated Mar. 23, 2010 for International Application No. PCT/EP2009/001480.

*Primary Examiner* — Jimmy T Nguyen
(74) *Attorney, Agent, or Firm* — Shlesinger, Arkwright & Garvey LLP

(57) ABSTRACT

The invention relates to a compacting device (1) for compacting empty containers, in particular beverage bottles or cans of plastic or metal, comprising at least one rotatable roller (1*a*, 1*b*), which is designed for compressing and perforating empty containers, wherein the roller (1*a*, 1*b*) has a roller base body (2*a*, 2*b*) and at least one pin element (3) protruding from the roller base body (2*a*, 2*b*), wherein the pin element (3) is formed as a hollow pin, at least the end face of the hollow pin that is facing away from the roller base body (2*a*, 2*b*) is open.

36 Claims, 3 Drawing Sheets

(56) References Cited

U.S. PATENT DOCUMENTS

| | | | | |
|---|---|---|---|---|
| 5,890,424 | A * | 4/1999 | Deters | 100/37 |
| 6,131,509 | A * | 10/2000 | Davis | 100/39 |
| 6,869,250 | B2 * | 3/2005 | Moyna | 404/124 |
| 2006/0288886 | A1 * | 12/2006 | Schwelling | 100/902 |
| 2009/0064877 | A1 * | 3/2009 | Benjamins | 100/98 R |

* cited by examiner

COMPACTING DEVICE

The invention relates to a compacting device for compacting empty containers, in particular beverage bottles or cans of plastic or metal, such as tin or aluminum.

DE 103 25 368 B4 describes a compacting device which has two counter-rotating driven rollers, which are arranged parallel to each other and with a space between them so that empty containers can be cut and compressed between them. For this purpose, each roller has multiple disks that are consecutively mounted along a roller axis. Some of the disks are designed as pressure disks; the other disks are cutting disks. The rollers are furthermore arranged such that the disks of the one roller fit in the spaces between the disks of the other roller. An empty container is drawn into the space between the rollers by the counter-rotating motion of the rollers and is compressed and cut by the pressure and cutting disks. This design also facilitates compacting-empty closed containers, without having to perforate them beforehand.

DE 85 15 290 U1 describes a generic compacting device. This device has at least one roller for compressing and perforating empty containers, wherein pin elements project radially from the roller base body. The pin elements are driven into recesses of the roller base body by pressfit and are mounted therein by means of a metal adhesive.

The object of the present invention is to provide a generic compacting device which has a simple design and is suitable to compact empty containers effectively. A compacting device is disclosed to solve this problem comprising at least one rotatable roller, which is designed for compressing and perforating empty containers. The roller has a roller base body and at least on pin element projecting from the roller base body.

Advantageous embodiments of the compacting device are also disclosed. In certain embodiments, the compacting device for compacting empty containers, in particular beverage bottles or cans of plastic or metal, is characterized in that at least one pin element is constructed as a hollow pin and where at least the face of the hollow pin facing away from the roller base body is open.

A pin element with that type of construction makes it possible for perforation and compression of a container can be achieved in the same process. For this purpose, a multiplicity of pin elements are preferably arranged on the roller base body. Such projecting pin elements improves the movement of containers into the compacting device. For example, such an arrangement allows the pin elements to catch uneven sections of the container and in this manner carry along the container.

In an advantageous embodiment of the invention, the roller base body has a recess into which the at least one pin element is inserted. The insertion of the pin element into the roller base body ensures that, in the event of damage or wear of individual pin elements, the affected pin elements can be replaced. Therefore, the replacement of the roller base body and/or the disassembly of the roller base body, as required in prior art, is not required in this embodiment.

Furthermore, the insertion of the pin elements into the roller base body also ensures that it will withstand the forces acting during the compression and perforation of containers, without loosening from the roller base body.

In a particularly advantageous embodiment of the invention, spiral pins are used as hollow pins. Because of their radial elastic properties, it is ensured that the spiral pins do not loosen from the roller base body when subjected to loads such as occur during the operation of the compacting device. To replace worn spiral pins, these can be easily extracted from the roller base body by rotating them to tighten the spiral, thereby reducing the outside diameter of the spiral pin so that it is smaller than the hole in the roller base body.

Because at least one pin element projects from the roller base body, the roller base body is subjected to smaller loads. This is the case especially if a multiplicity of pin elements is arranged uniformly on the roller base body. This makes it possible to use materials for the design of the roller base body that would typically only be able to handle lighter loads, such as a cost-effective plastic material. The roller base body of some embodiments can be produced as a single-piece plastic injection molding.

BRIEF DESCRIPTION OF THE DRAWINGS

Exemplary embodiments of the invention are described in the following Figures.

The same components or those which correspond to each other are designated with identical reference numbers in the Figures.

DETAILED DESCRIPTION

The compacting device 1 comprises a housing 17; two rollers 1*a*, 1*b*, arranged in the housing 17 for compacting empty containers, in particular beverage bottles or cans of plastic or metal, such as tin or aluminum; a feeding device 13 which is also arranged in the housing 17 so that the container being drawn-in by the rollers 1*a*, 1*b*, can be pressed against the rollers 1*a*, 1*b*; and a drive mechanism 10, which allows the rollers 1*a*, 1*b*, and the feeding device 13 to be driven.

Figure 1:
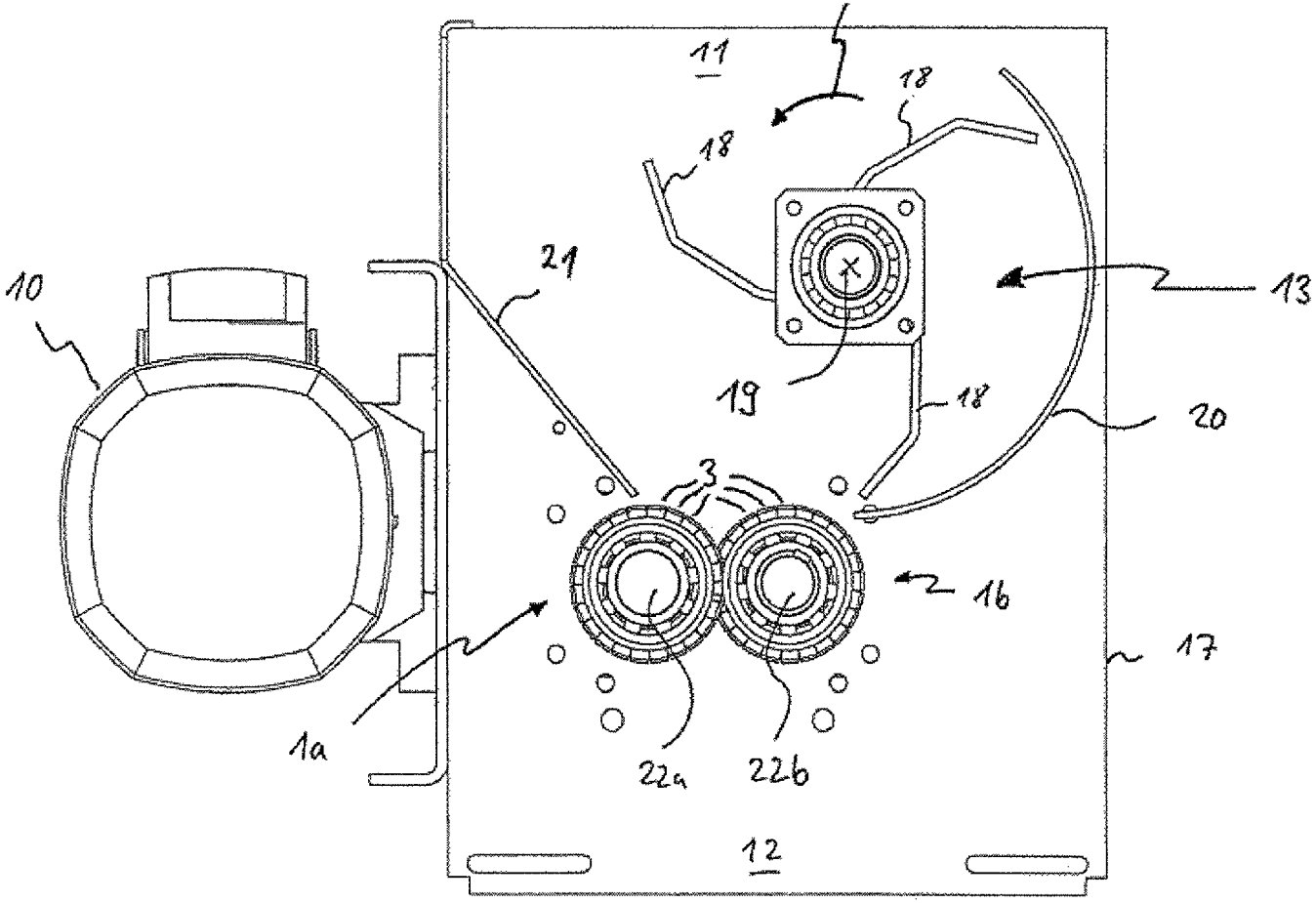
FIG. 1 is a schematic side-view of an embodiment of a compacting device as taught by the invention.
Figure 2:
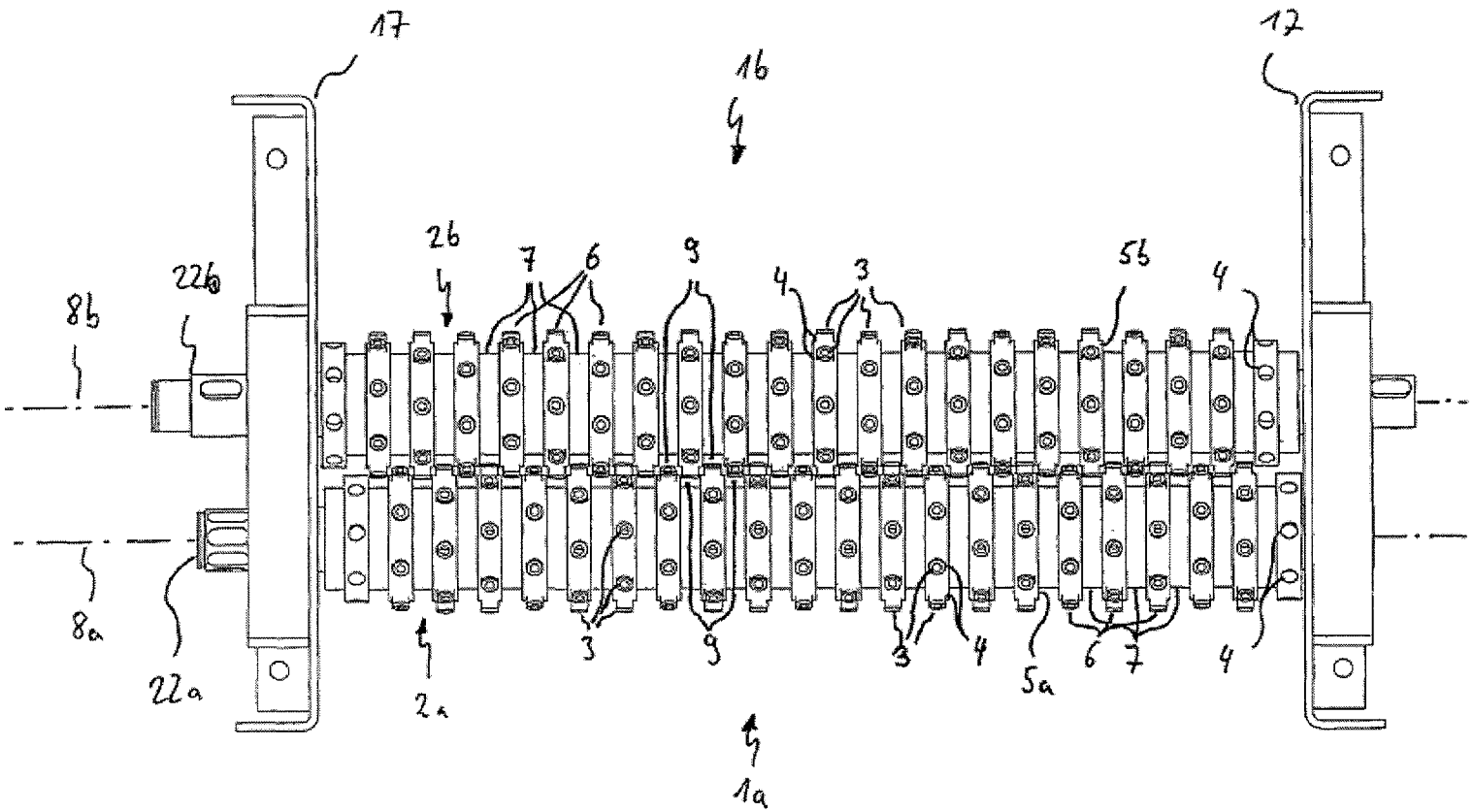
FIG. 2 is a horizontal projection of a first roller and a second roller of the compacting device, and FIG. 3 *a-c* is a spiral pin in the unloaded state, in a mounted state, and when subjected to a load.

In its upper area, the housing 17 has an inlet opening 11 for the loading of containers to be compacted. An inclined chute 21 may be provided for supplying the containers to the rollers 1*a*, 1*b*, which may be arranged at the end of the chute 21. The feed is assisted by a rotary motion of the feeding device 13. The feeding device may be designed as a paddle mechanism 13 and includes three paddles 18 which, in this embodiment, are equally arranged peripherally on a paddle shaft 9. A paddle 18 may be formed by a sheet that is angled twice clockwise toward the inside, wherein the sheet extends longitudinally along the paddle shaft 19. By an anti-clockwise rotation of the paddle shaft 19, marked with an arrow 24 in FIG. 1, the paddles 18 supply an empty container to the rollers 1*a*, 1*b*, and the rollers 1*a*, 1*b*, assist in drawing in the container. The paddle shaft 19 may be rotatably mounted on the housing 17 via a ball bearing.

The feeding device 13 may include a circularly bent feedback plate 20, wherein the feedback plate 20 extends from the area of the rollers 1*a*, 1*b*, up to an area above the paddle shaft 19. If a container is not drawn-in by the rollers 1*a*, 1*b*, then this container may be carried along by the rotating paddles 18, directed along the feedback plate 20, being rotated around by the paddles 18 until it again reaches the rollers 1*a*, 1*b*.

The first roller 1*a* and the second roller 1*b* are arranged horizontally and, preferably, parallel to one another. The first roller 1*a* and the second roller 1*b* each comprise a roller base body 2*a* and 2*b*, respectively, and a plurality of pin elements 3 that are arranged on the respective roller base body 2*a*, 2*b*. The first roller base body 2*a* is fixed on a first driveshaft 22*a*; the second roller base body 1*b* is fixed on the second shaft 22*b*. The shafts 22*a*, 22*b*, may be rotatably mounted on the housing 17 by means of ball bearings.

The first roller base body 2*a* and the second roller base body 2*b* essentially have a cylindrical shape. The roller base bodies 2*a*, 2*b*, may be further subdivided into first disk-shaped sections 6 and second disk-shaped sections 7. The first sections and the second sections 7 are each arranged sequentially, alternating with one another, along a roller axis 8*a*, 8*b*, respectively. The roller axes 8*a*, 8*b*, correspond to the axes of the shafts 22*a* and 22*b*, respectively. In the embodiment as shown, a first section 6 is designed with a larger diameter than a second section 7. The first sections 6 and the second sections 7 may have the same width.

Recesses 4 for the insertion of pin elements 3, according to the embodiment as shown, are formed in the first sections 6. The second sections 7, as shown, do not have such recesses 4. A recess 4 is formed by a cylindrical cutout which forms a hole, and the hole is aligned radially facing out compared to the roller axis 8*a* and/or 8*b*. A first section 6 may have a plurality of such recesses 4, which may be arranged uniformly around the roller axis 8*a*, 8*b*. The recesses of adjacent first sections 6, may be offset at a certain angle, here 15°, which results in a helical arrangement of the recesses 4 along the roller axes 8*a*, 8*b*.

In some embodiments, pin elements 3 may be inserted into all recesses 4 except for the recesses in the first and last sections 6, which are located on each end of the roller base body 2*a*, 2*b*. The depths of the recesses 4 and the diameter of the recesses 4 are adapted to the respective dimensions of the pin elements 3, so that a pin element 3, inserted into a recess 4, will project beyond the recess 4.

The first roller 1*a* and the second roller 1*b* may be spaced apart from one another such that the pin elements 3 of the first roller 1*a* fit into the spaces 9 between the two first sections 6 of the second roller 1*b*, and the pin elements 3 of the second roller 1*b* fit into the spaces 9 between the first two sections 6 of the first roller 1*a*.

Figures 3A, 3B, 3C:
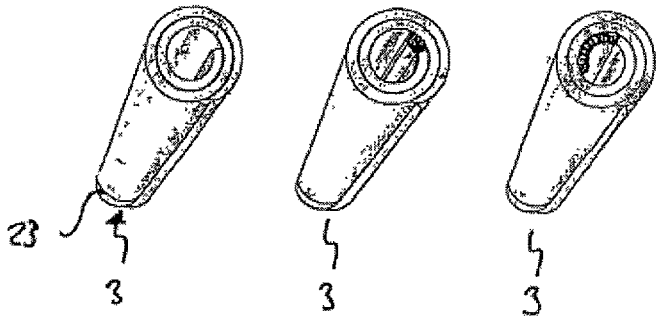

A standard commercially available spiral pin 3 is used as pin element, (see FIGS. 3*a* to 3*c*). The spiral pin 3 consists of a spirally wound elastic sheet, preferably spring steel sheet, which has a conical bevel 23 on one end in order to simplify the insertion into the recess 4. The spiral pin 3 is compressed in the assembled state, see FIG. 3*b*, and is therefore subjected to radial tension. Because of this radial tension, it is possible to achieve an effective connection with the roller base body 2*a*, 2*b*.

The spiral pin 3 can deform further when subjected to load in the inserted state, see FIG. 3*c*. In an exemplary embodiment, the spiral pin 3 has a diameter in the range of 5 to 10 mm, preferably approximately 8 mm, and the length in a range of 12 to 30 mm, preferably approximately 21 mm.

The drive mechanism 10, which is an electric motor in the embodiment as shown, is connected with the shafts 22*a*, 22*b* of the rollers 1*a*, 1*b*, and the paddle shaft 19 via gears and drive chains (not shown) in order to drive them. During operation, the rollers 1*a*, 1*b*, perform a counter-rotating rotary motion, wherein the first shaft 1*a* may rotate clockwise and the second shaft 1*b* may rotate counter-clockwise. The paddle shaft 19 and, therefore, the paddles 18 rotate counter-clockwise.

An empty container which reaches the area of the rollers 1*a*, 1*b* via the inlet opening 11 or via the feedback plate 21, will be pulled into the between the rollers 1*a*, 1*b*, by the counter-rotating rollers 1*a*, 1*b*. This drawing-in is assisted by the rotating paddles 18, which, in addition, may press an empty container against the rollers 1*a*, 1*b*. The drawing-in is furthermore assisted by the spirally offset pin elements 3, projecting from the roller base body 2*a*, 2*b*. Usually, the empty container is drawn-in by the rollers 1*a*, 1*b*, and perforated and compressed by the pin elements 3 and the roller base bodies 2*a*, 2*b*. The container compacted in this manner may be discharged via the discharge opening 12. In the event that an empty container is not drawn-in, it will be supplied again to the rollers 1*a*, 1*b*, via the feedback plate 21 and the rotating paddles 18.

A scraper device can be provided in order to assist the scraping off of a compacted container from the rollers 1*a*, 1*b*. In this context, the roller base bodies 2*a*, 2*b*, may be designed as single-piece plastic injection moldings. Alternatively, the use of a metal roller base body is also possible, for example.

The invention claimed is:

1. A compacting apparatus for compacting empty containers, the apparatus comprising:

at least one rotatable roller for compacting the empty containers, the roller including a roller base body, the roller base body having at least one recess capable of receiving a spiral pin, and a spiral pin including a spiral wound sheet, the spiral pin being compressed in the at least one recess, subjected to radial tension, and projecting from the roller base body, an outward facing end of the spiral pin being open, and the spiral pin in the at least one recess can deform further when subjected to load.

2. The apparatus of claim 1, wherein: the roller base body comprises at least one first section and at least one second section along the roller axis, the diameter of at least one first section is greater than the diameter of at least one second section, and at least one spiral pin is arranged on the at least one first section.

3. The apparatus of claim 2, wherein more than one pin is arranged uniformly around at least one first section.

4. The apparatus of claim 2, wherein:

more than one pin is arranged uniformly around a first one of the first sections, more than one pin is arranged uniformly around a second one of the first sections, and the pins around the first one of the first sections are offset against the pins around the second one of the first sections.

5. The apparatus of claim 1, wherein the at least one rotatable roller includes a first rotatable roller and a second rotatable roller, the first and second rotatable rollers arranged parallel to one another and with a space between the first and second rotatable rollers.

6. The apparatus of claim 2, wherein the at least one rotatable roller includes a first rotatable roller and a second rotatable roller, the first and second rotatable rollers arranged parallel to one another and with a space between the first and second rotatable rollers.

7. The apparatus of claim 3, wherein the at least one rotatable roller includes a first rotatable roller and a second rotatable roller, the first and second rotatable rollers arranged parallel to one another and with a space between the first and second rotatable rollers.

8. The apparatus of claim 4, wherein the at least one rotatable roller includes a first rotatable roller and a second rotatable roller, the first and second rotatable rollers arranged parallel to one another and with a space between the first and second rotatable rollers.

9. The apparatus of claim 5, wherein:

the first rotatable roller and the second rotatable roller are arranged such that at least one pin element of the first rotatable roller fits into a space between a first one of a plurality of first sections of the second rotatable roller and a second one of the first sections of the second rotatable roller, and the first rotatable roller and the second rotatable roller are arranged such that at least one pin element of the second rotatable roller fits into the space between a first one of the first sections of the first rotatable roller and a second one of the first sections of the first rotatable roller.

10. The apparatus of claim 6, wherein:

the first rotatable roller and the second rotatable roller are arranged such that at least one pin element of the first rotatable roller fits into a space between a first one of a plurality of first sections of the second rotatable roller and a second one of the first sections of the second rotatable roller, and the first rotatable roller and the second rotatable roller are arranged such that at least one pin element of the second rotatable roller fits into the space between a first one of a plurality of first sections of the first rotatable roller and a second one of the first sections of the first rotatable roller.

11. The apparatus of claim 7, wherein:

the first rotatable roller and the second rotatable roller are arranged such that at least one pin element of the first rotatable roller fits into a space between a first one of a plurality of first sections of the second rotatable roller and a second one of the first sections of the second rotatable roller, and the first rotatable roller and the second rotatable roller are arranged such that at least one pin element of the second rotatable roller fits into the space between a first one of a plurality of first sections of the first rotatable roller and a second one of the first sections of the first rotatable roller.

12. The apparatus of claim 8, wherein:

the first rotatable roller and the second rotatable roller are arranged such that at least one pin element of the first rotatable roller fits into a space between a first one of a plurality of first sections of the second rotatable roller and a second one of the first sections of the second rotatable roller, and the first rotatable roller and the second rotatable roller are arranged such that at least one pin element of the second rotatable roller fits into the space between a first one of a plurality of first sections of the first rotatable roller and a second one of the first sections of the first rotatable roller.

13. The apparatus of claim 1 further comprising a feeding device, wherein the feeding device feeds a container to the at least one rotatable roller.

14. The apparatus of claim 2 further comprising a feeding device, wherein the feeding device feeds a container to the at least one rotatable roller.

15. The apparatus of claim 3 further comprising a feeding device, wherein the feeding device feeds a container to the at least one rotatable roller.

16. The apparatus of claim 4 further comprising a feeding device, wherein the feeding device feeds a container to the at least one rotatable roller.

17. The apparatus of claim 5 further comprising a feeding device, wherein the feeding device feeds a container to the at least one rotatable roller.

18. The apparatus of claim 6 further comprising a feeding device, wherein the feeding device feeds a container to the at least one rotatable roller.

19. The apparatus of claim 7 further comprising a feeding device, wherein the feeding device feeds a container to the at least one rotatable roller.

20. The apparatus of claim 8 further comprising a feeding device, wherein the feeding device feeds a container to the at least one rotatable roller.

21. The apparatus of claim 9 further comprising a feeding device, wherein the feeding device feeds a container to the at least one rotatable roller.

22. The apparatus of claim 10 further comprising a feeding device, wherein the feeding device feeds a container to the at least one rotatable roller.

23. The apparatus of claim 11 further comprising a feeding device, wherein the feeding device feeds a container to the at least one rotatable roller.

24. The apparatus of claim 12 further comprising a feeding device, wherein the feeding device feeds a container to the at least one rotatable roller.

25. The apparatus of claim 13, wherein the feeding device is capable of carrying a container that is not drawn in by the at least one roller and re-presenting the container that is not drawn in to the at least one roller.

26. The apparatus of claim 14, wherein the feeding device is capable of carrying a container that is not drawn in by the at least one roller and re-presenting the container that is not drawn in to the at least one roller.

27. The apparatus of claim 15, wherein the feeding device is capable of carrying a container that is not drawn in by the at least one roller and re-presenting the container that is not drawn in to the at least one roller.

28. The apparatus of claim 16, wherein the feeding device is capable of carrying a container that is not drawn in by the at least one roller and re-presenting the container that is not drawn in to the at least one roller.

29. The apparatus of claim 17, wherein the feeding device is capable of carrying a container that is not drawn in by the at least one roller and re-presenting the container that is not drawn in to the at least one roller.

30. The apparatus of claim 18, wherein the feeding device is capable of carrying a container that is not drawn in by the at least one roller and re-presenting the container that is not drawn in to the at least one roller.

31. The apparatus of claim 19, wherein the feeding device is capable of carrying a container that is not drawn in by the at least one roller and re-presenting the container that is not drawn in that is not drawn in to the at least one roller.

32. The apparatus of claim 20, wherein the feeding device is capable of carrying a container that is not drawn in by the at least one roller and re-presenting the container that is not drawn in to the at least one roller.

33. The apparatus of claim 21, wherein the feeding device is capable of carrying a container that is not drawn in by the at least one roller and re-presenting the container that is not drawn in to the at least one roller.

34. The apparatus of claim 22, wherein the feeding device is capable of carrying a container that is not drawn in by the at least one roller and re-presenting the container that is not drawn in to the at least one roller.

35. The apparatus of claim 23, wherein the feeding device is capable of carrying a container that is not drawn in by the at least one roller and re-presenting the container that is not drawn in to the at least one roller.

36. The apparatus of claim 24, wherein the feeding device is capable of carrying a container that is not drawn in by the at least one roller and re-presenting the container that is not drawn in to the at least one roller.

* * * * *